US005228872A

United States Patent [19]

Liu

[11] Patent Number: 5,228,872

[45] Date of Patent: Jul. 20, 1993

[54] SHIELDED IDC TYPE MODULAR JACK ADAPTER

[75] Inventor: Danny Liu, Hsin-Tien, Taiwan

[73] Assignee: Dan-Chief Enterprise Co., Ltd., Hsin-tien, Taiwan

[21] Appl. No.: 878,518

[22] Filed: May 5, 1992

[51] Int. Cl.[5] ..... H01R 13/648

[52] U.S. Cl. ..... 439/607; 439/76; 439/676; 439/404

[58] Field of Search ..... 439/395, 403, 404, 405, 439/76, 79, 607, 609, 610, 676

[56] References Cited

U.S. PATENT DOCUMENTS

| | | | |
|---|---|---|---|
| 4,820,192 | 4/1989 | Denkmann et al. | 439/676 X |
| 4,838,811 | 6/1989 | Nakamura et al. | 439/610 X |
| 4,983,127 | 1/1991 | Kawai et al. | 439/79 |
| 5,096,442 | 3/1992 | Arnett et al. | 439/404 X |
| 5,118,310 | 6/1992 | Stroede et al. | 439/405 X |

FOREIGN PATENT DOCUMENTS

| | | | |
|---|---|---|---|
| 0266784 | 11/1988 | Japan | 439/676 |
| 0162667 | 6/1990 | Japan | 439/676 |

*Primary Examiner*—Larry I. Schwartz
*Assistant Examiner*—Khiem Nguyen
*Attorney, Agent, or Firm*—Beveridge, DeGrandi, Weilacher & Young

[57] ABSTRACT

A replaceable and desirable modular jack adapter capable of easily discharging static electricity is provided. The adapter includes a modular jack having a socket, spacedly disposed spring wires, an insulation displacement connector for positioning therein terminals, a printed circuit board respectively electrically connecting the spring wires with the terminals, and a conducting shell mounted around the socket and electrically connected to one of the terminals capable of discharging therethrough any static electricity in the shell.

10 Claims, 2 Drawing Sheets

SHIELDED IDC TYPE MODULAR JACK ADAPTER

BACKGROUND OF THE INVENTION

The present invention relates to an adapter, and more particularly to a modular jack adapter.

A modular jack being easy in connection is getting more and more popular in connection boxes, wall plates and patch panels of various switchboards in telephone, computer and communication networks. It has been known to use in a patch panel of a switchboard, a modular jack which, however, is welded and screwed to the patch panel so that it is relatively inconvenient and uneasy to get the modular jack repaired. It has also been known to mount, on a wall plate, a replaceable modular jack which, nevertheless, suffers from the following disadvantages:

1) An insulation displacement connector (hereinafter abbreviated as IDC) positions therein an entire row of terminals, which are, therefore, relatively small in size, relatively weak in strength and relatively few in number.

2) Static electricity can cause a computer to be out of order, a communication to be noisy . . . etc. This situation will become worse in a dry area.

It is attempted by the Applicant to deal with the above situation encountered by the prior art.

SUMMARY OF THE INVENTION

It is therefore an object of the present invention to provide a shielded IDC type modular jack adapter capable of being replaceably used in a connection box, a wall plate and patch panels of switchboards.

It is further an object of the present invention to provide a shielded IDC type modular jack adapter capable of easily discharging thereout static electricity.

It is yet an object of the present invention to provide a shielded IDC type modular jack adapter being of enough strength and capable of avoiding an inner short-circuit.

According to the present invention, a shielded IDC type modular jack adapter includes a modular jack having a socket, spacedly disposed spring wires, an IDC for positioning therein terminals, a printed circuit board respectively electrically connecting spring wires with terminals, and a conducting shell mounted around the socket and electrically connected to one of the terminals capable of discharging therethrough static electricity occurring in the shell.

Certainly, the spring wires and the terminals can be welded to the printed circuit board. Preferably, the present adapter further includes a second IDC vertically spaced from the first IDC and having terminals respectively connecting thereon and conducting therewith additional foreign conducting wires.

Certainly, both sides of the board can have printed circuits so that welding spots thereon can have a greater mutual distance. The present adapter can be equipped with a tool capable of matching with the IDC to connect and conduct the terminals with the foreign conducting wires placed between the IDC and the tool.

The conducting shell can have a first extension leg penetrating into the modular jack and connected to the one terminal, and can have a second extension leg having a bent free end penetrating into the jack for assistantly positioning the shell. Certainly, the modular jack can have side grooves capable of engaging therein corresponding inner protuberances of the extension legs for preferably positioning the shell around the socket.

The present adapter can be replaceably mounted on a wall plate, a connection box or a patch panel of a kind of switchboard.

BRIEF DESCRIPTION OF THE DRAWINGS

The present invention may best be understood through the following description with reference to the accompanying drawings, in which.

DETAILED DESCRIPTION OF THE PREFERRED EMBODIMENT

Figure 1:
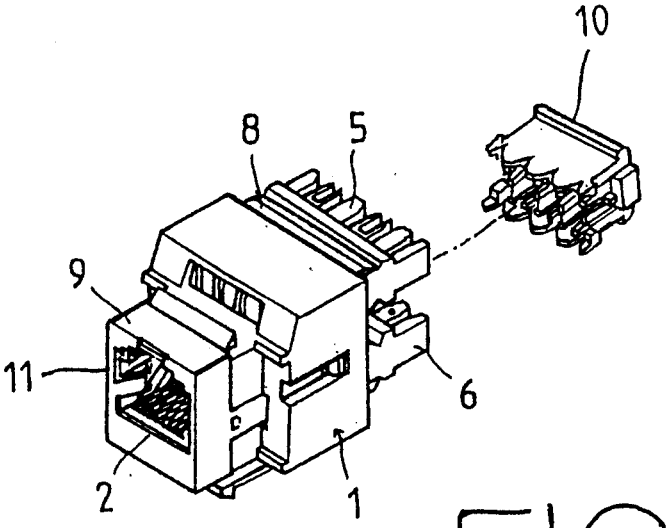
FIG. 1 is a perspective view showing a preferred embodiment of a shielded IDC type modular jack adapter according to the present invention.
Figure 2:
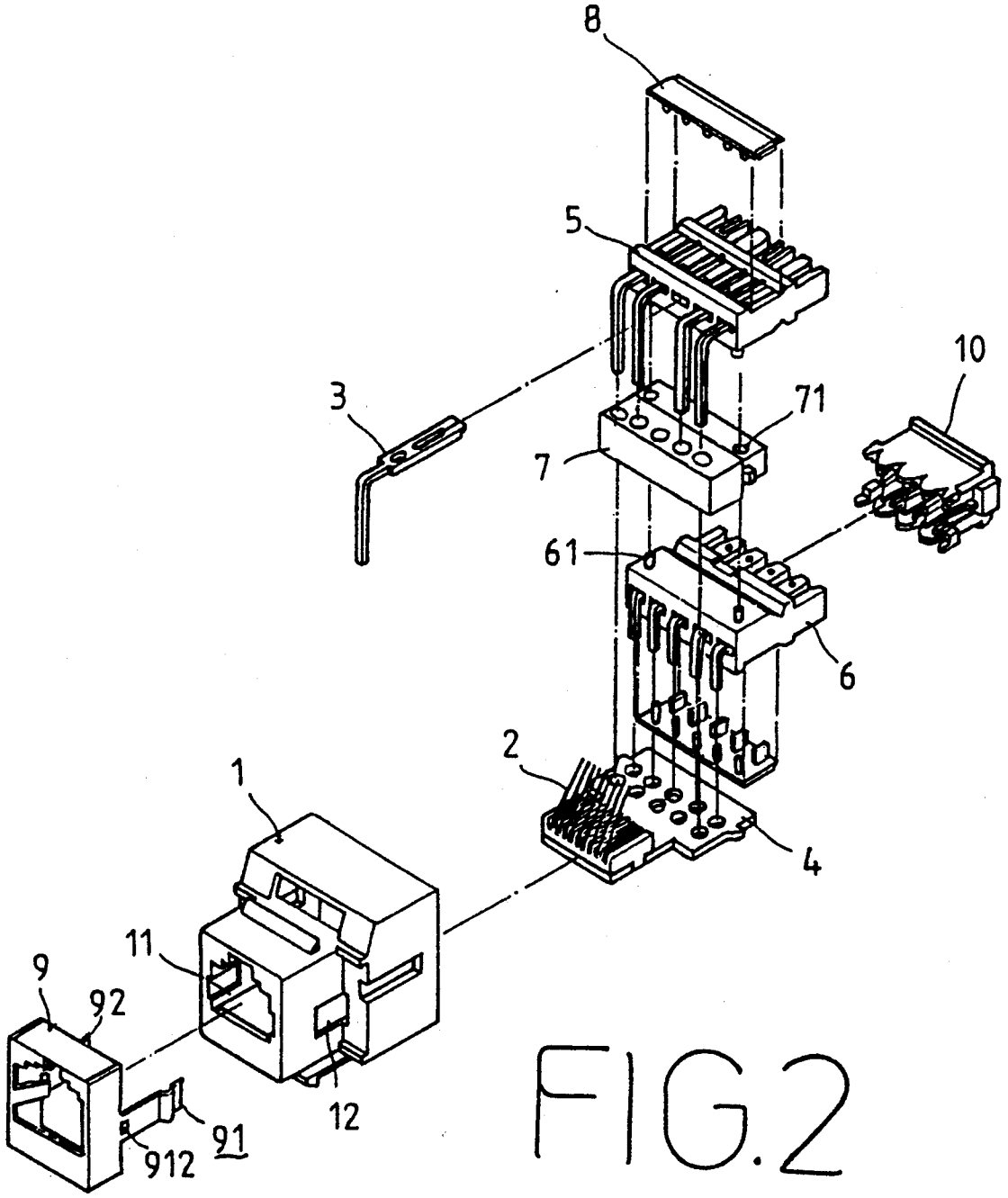
FIG. 2 is an exploded view showing an adapter in FIG. 1.

Referring now to FIGS. 1 & 2, a preferred embodiment of a shielded IDC type modular jack adapter according to the present invention includes a modular jack 1, plural spring wires 2, a printed circuit board 4 having printed circuits 41 on both sides, two vertically spaced IDCs 5, 6 having terminals 3, an IDC-positioner 7, a terminal positioner 8, a conducting shell 9 and a tool 10, in which modular jack 1 wholly or partly receives therein elements 1–8 and has a socket hole 11 capable of inserting therein a modular plug.

Spring wires 2 and terminals 3 are respectively welded to printed circuits 41 on both sides of board 4 so that every two most adjacent welding spots on the board 4 can have a greater mutual distance to prevent a short circuit phenomenon therebetween.

After terminals 3 have been inserted into IDC 5(6), positioner 8, being plastic, can be fitted and heatedly welded (e.g. by a supersonic wave) to IDC 5(6), thus securely positioning therein terminals 3 to be welded on board 4. Positioner 7 has holes for passing therethrough terminals 3 of IDC 5 and has through holes 71 capable of fitting therein lugs 51(61) of IDC 5(6). The positioner 7 can thus help position IDCs 5, 6 on board 4.

Shell 9 includes a first extension leg 91 penetrating into modular jack 1 to electrically contact with one of terminals 3 for discharging therefrom static electricity, and a second extension leg 92 having a bent free end penetrating into jack 1 for assistantly positioning shell 9 around the socket, in which extension legs 91, 92 have inner protuberances 912 capable of respectively engaging in corresponding side grooves 12 of jack 1 for preferably positioning shell 9 around the socket having hole 11.

Tool 10 is capable of matching with IDC 5(6) to connect/conduct terminals 3 with foreign conducting wires placed between IDC 5(6) and tool 10 pressed against IDC 5(6).

It is to be noticed that the present adapter can be replaceably used with connection boxes, wall plates and patch panels of various switchboards.

The above described embodiment is only illustrative but not limitative, the scope of the present invention is to be broadly interpreted by the appended claims.

What I claim is:

1. A shielded IDC type modular jack adapter, comprising:

a modular jack having a socket adapted to insert therein a modular plug;

a first insulation displacement connector received in said jack, and positioning therein a first plurality of terminals adapted to respectively connect thereon and conduct therewith a first plurality of foreign conducting wires;

a printed circuit board mounted in said jack;

a second insulation displacement connector spaced from said first insulation displacement connector and having a second plurality of terminals adapted to respectively connect thereon and conduct therewith a second plurality of foreign conducting wires; and a plurality of spring wires spacedly disposed on said printed circuit board, capable of being in conduction with said plug and being electrically connected to said first and second terminals.

2. An adapter according to claim 1 wherein said spring wires and said terminals are respectively welded to said printed circuit board.

3. An adapter according to claim 1 wherein both sides of said board have printed circuits.

4. An adapter according to claim 1, further comprising a tool capable of matching with said insulation displacement connector to connect and conduct said terminals with said foreign conducting wires placed between said connector and said tool.

5. An adapter according to claim 1 wherein said adpater is replaceably adapted to be mounted on one of a wall plate, a connection box and patch panels of switchboards.

6. An adapter according to claim 1 wherein said conducting shell has a first extension leg penetrating into said modular jack and connected to said one terminal.

7. An adapter according to claim 6 wherein said conducting shell has a second extension leg having a bent free end penetrating into said modular jack for assistantly positioning said shell.

8. An adapter according to claim 7 wherein said extension legs have inner protuberances, and said modular jack has corresponding side grooves capable of engaging therein said protuberances for preferably positioning said shell around said socket.

9. An adapter according to claim 1, further comprising a conducting shell mounted around said socket and electrically connected to one of said terminals, said conducting shell capable of discharging static electricity occurring in said shell.

10. An adapter according to claim 1, wherein said first insulation displacement connector is vertically spaced from said second insulation displacement connector.

* * * * *